US009970132B2

(12) United States Patent
Wu

(10) Patent No.: US 9,970,132 B2
(45) Date of Patent: May 15, 2018

(54) WOVEN CLOTH

(71) Applicant: Tsung-Jung Wu, Taichung (TW)

(72) Inventor: Tsung-Jung Wu, Taichung (TW)

( * ) Notice: Subject to any disclaimer, the term of this patent is extended or adjusted under 35 U.S.C. 154(b) by 0 days. days.

(21) Appl. No.: 15/232,045

(22) Filed: Aug. 9, 2016

(65) Prior Publication Data

US 2017/0175306 A1 Jun. 22, 2017

(30) Foreign Application Priority Data

Dec. 18, 2015 (TW) ..... 104220400 U

(51) Int. Cl.
*D03D 13/00* (2006.01)
*D03D 3/00* (2006.01)

(52) U.S. Cl.
CPC ..... *D03D 3/00* (2013.01)

(58) Field of Classification Search
CPC ..... D03D 27/00; D03D 3/02; D03D 11/00; D03D 11/02; D03D 19/00; D03D 2700/60; D03D 27/12; D03D 1/00; D03D 3/06; D03D 47/06; D03D 25/005; D03D 21/14; D03D 21/06; D03D 21/10; D03D 21/16; D03D 21/18; D03D 25/12; D03D 21/12
See application file for complete search history.

(56) References Cited

U.S. PATENT DOCUMENTS 3,654,056 A * 4/1972 Nisbit et al. ..... D05C 17/02 28/140
4,048,399 A * 9/1977 Terzaghi ..... H01M 4/765 139/387 R
4,189,931 A * 2/1980 Groshens ..... A41D 27/06 66/193
4,333,321 A * 6/1982 Schneider ..... D04B 21/02 66/190
4,344,463 A * 8/1982 Muller ..... D03D 47/06 139/117
4,500,578 A * 2/1985 van de Kamp ..... B66C 1/18 428/102
4,581,905 A * 4/1986 Bonaschi ..... D04B 25/12 66/203
4,589,450 A * 5/1986 Eisenlohr ..... D03C 7/06 139/54
4,651,620 A * 3/1987 Lyons ..... D04G 1/08 289/1.2

(Continued)

FOREIGN PATENT DOCUMENTS

TW 200922780 6/2009
TW M445027 1/2013
TW M455021 6/2013

*Primary Examiner* — Bobby Muromoto, Jr.
(74) *Attorney, Agent, or Firm* — Muncy, Geissler, Olds & Lowe, P.C.

(57) ABSTRACT

The woven cloth is composed of a plurality of longitudinal threads and a plurality of horizontal threads. Each of the longitudinal threads is woven by a plurality of filaments. The longitudinal threads are spacedly arranged parallel. The horizontal threads are spacedly arranged and are woven with the longitudinal threads so that the woven cloth has a plurality of holes among the longitudinal threads and the horizontal threads. Each of the horizontal thread is tied with the longitudinal threads to form a plurality of knots. Each of the knots is located between two adjacent ones of the holes.

11 Claims, 2 Drawing Sheets

(56) References Cited

U.S. PATENT DOCUMENTS 5,238,728 A * 8/1993 Aucagne ..... B29C 70/24 428/109
5,662,147 A * 9/1997 Haiber ..... D03D 11/02 139/384 R
5,865,464 A * 2/1999 Kanuma ..... B60R 21/235 280/743.1
7,287,553 B2 * 10/2007 Wahhoud ..... D03C 7/06 139/101
7,348,285 B2 * 3/2008 Dhawan ..... D02G 3/38 174/107
2003/0056846 A1 * 3/2003 Buesgen ..... B60R 21/18 139/1 R
2004/0057176 A1 * 3/2004 Dhawan ..... D02G 3/38 361/62
2004/0065380 A1 * 4/2004 Speich ..... D03C 19/005 139/383 R
2004/0185734 A1 * 9/2004 Gray ..... B29C 70/22 442/312
2006/0107701 A1 * 5/2006 Ternon ..... D04B 21/165 66/195
2006/0110995 A1 * 5/2006 Ternon ..... D04B 21/14 442/59
2008/0042115 A1 * 2/2008 Karatzis ..... D03C 7/06 256/1
2008/0287022 A1 * 11/2008 Dhawan ..... D02G 3/38 442/229
2009/0317569 A1 * 12/2009 Debaes ..... A41G 1/009 428/17
2011/0185620 A1 * 8/2011 Momoi ..... D04G 1/08 43/9.95
2012/0232655 A1 * 9/2012 Lorrison ..... A61F 2/0045 623/13.19
2012/0291908 A1 * 11/2012 Lama ..... D03D 27/12 139/400
2014/0326267 A1 * 11/2014 Peterson ..... A41G 5/0046 132/201
2014/0338784 A1 * 11/2014 Lama ..... D03D 27/00 139/400
2016/0081411 A1 * 3/2016 Shin ..... A41G 3/0041 132/201
2017/0130371 A1 * 5/2017 Harabayashi ..... D03D 11/02
2017/0145608 A1 * 5/2017 Ko ..... D04B 21/10

* cited by examiner

WOVEN CLOTH

BACKGROUND OF THE INVENTION

Field of the Invention

The present invention relates to a woven cloth.

Description of the Prior Art

A conventional woven cloth is shown in patents TW M455021, TW M445027, and publication TW 200922780. The woven cloth is woven by threads along a longitudinal directions and a horizontal direction. The threads must be woven tightly to prevent the cloth from deforming, but the gaps among the threads are too narrow so that the cloth cannot breathe well.

In addition, the tightly woven cloth has a restricted resilience. For example, if the cloth is used on a shoe surface, the surface may be too tight so as to reduce the comfort.

Besides, when some sections on the cloth must have different resilience, another piece of cloth having different resilience has to be assembled with the original cloth. Thus, it is difficult to manufacture, and the resilience is not continuous.

SUMMARY OF THE INVENTION

The main object of the present invention is to provide a woven cloth which breathe freely and is resilient so as to provide excellent softness and strength of structure.

To achieve the above and other objects, the woven cloth is composed of a plurality of longitudinal threads and a plurality of horizontal threads. Each of the longitudinal threads is woven by a plurality of filaments. The longitudinal threads are spacedly arranged parallel. The horizontal threads are spacedly arranged and are woven with the longitudinal threads so that the woven cloth has a plurality of holes among the longitudinal threads and the horizontal threads. Each of the horizontal thread is tied with the longitudinal threads to form a plurality of knots. Each of the knots is located between two adjacent ones of the holes.

Thereby, the woven cloth can breathe freely due to the holes, and the resilience is improved, specifically along an oblique direction. Besides, the softness is improved because of the tube-shaped threads.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
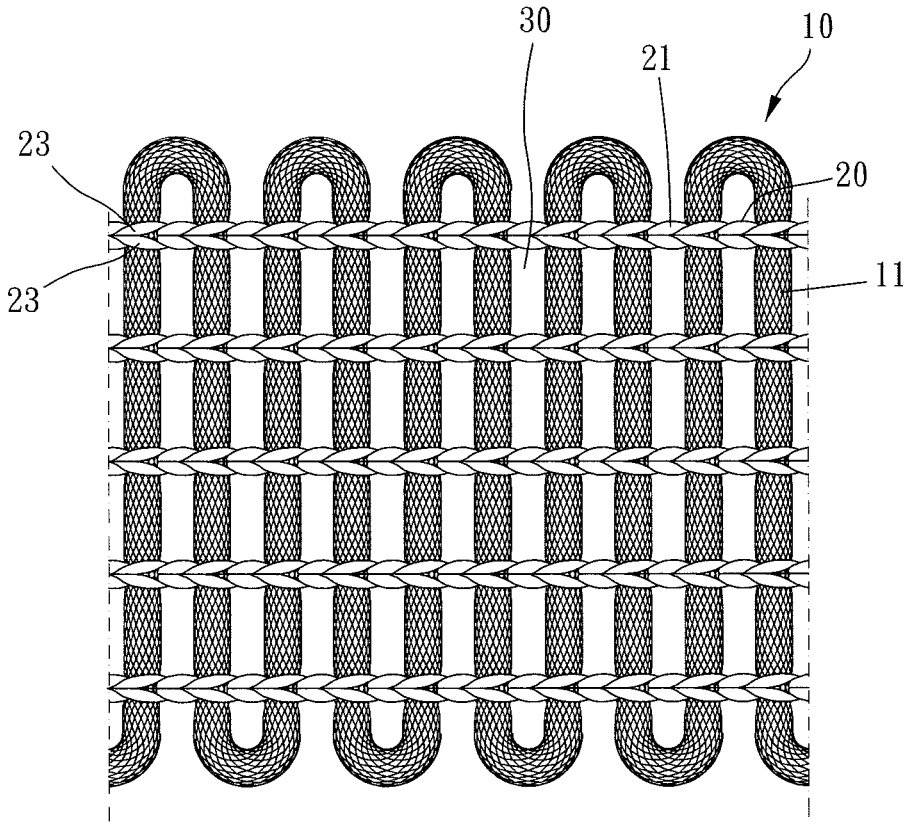
FIG. 1 is a front view of the present invention.
Figure 2:
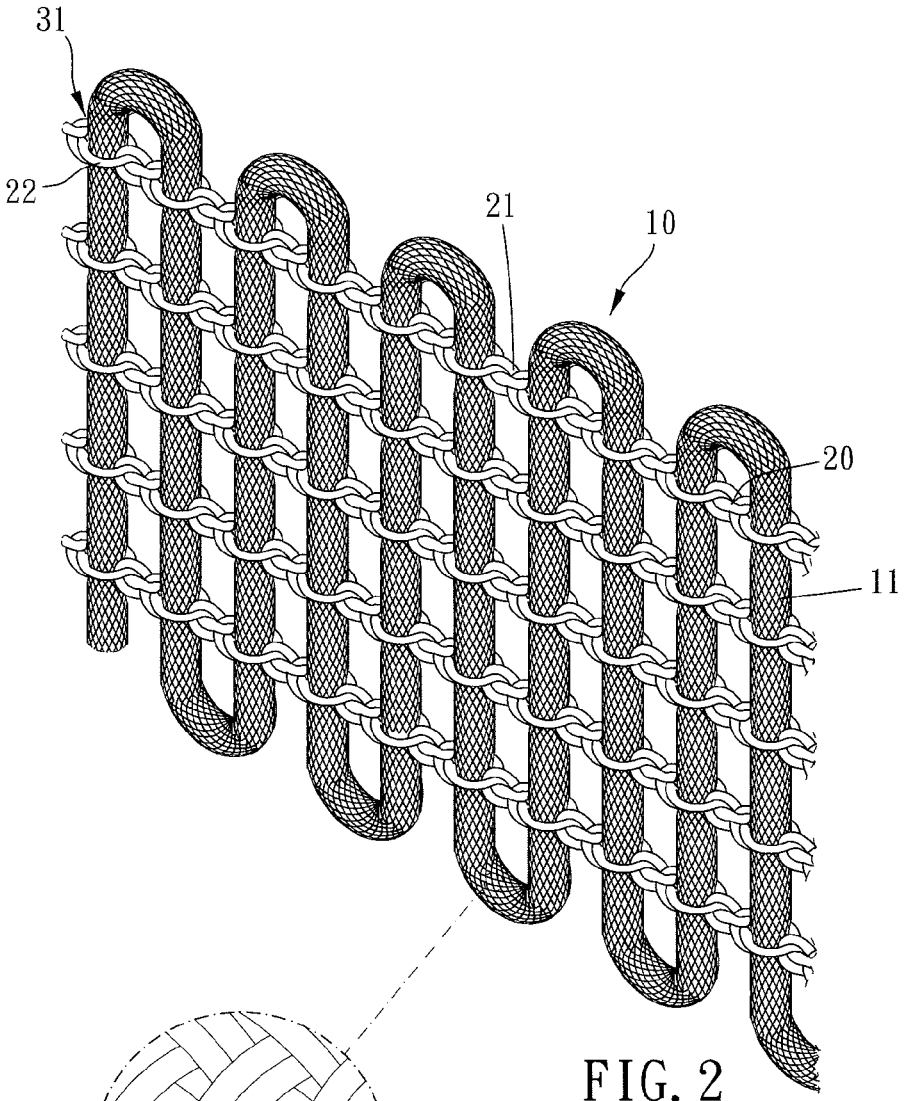
FIG. 2 is a stereogram of the present invention.
Figure 2A:
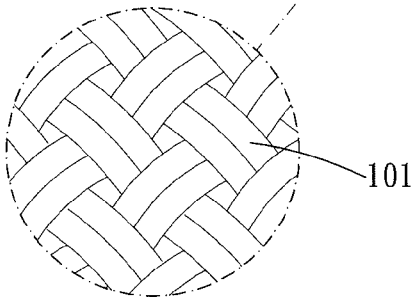
FIG. 2A is a partial enlargement of the present invention.
Figure 2B:
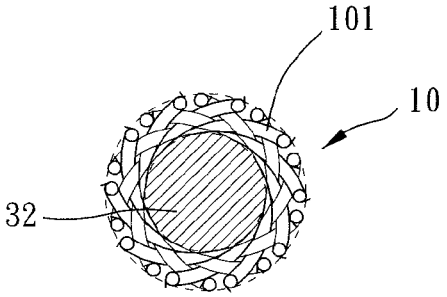
FIG. 2B is a profile of a longitudinal thread of the present invention.

Please refer to FIG. 1 to FIG. 2 and FIGS. 2A and 2B, the woven cloth is composed of a plurality of longitudinal threads 11 and a plurality of horizontal threads 20. Each of the longitudinal threads 11 is formed by a plurality of filaments 101. The longitudinal threads 11 are spacedly arranged parallel. The horizontal threads 20 are spacedly arranged and are woven with the longitudinal threads 11 so that a plurality of holes 30 are formed by the interlacing of the longitudinal threads 11 and the horizontal threads 20. Each of the horizontal threads 20 surrounds and ties respective one of the longitudinal threads 11, and each horizontal thread 20 itself knots to form a plurality of knots 21. Along respective one of the horizontal threads 20, between every two adjacent ones of common weaving interlacing points 31 of the longitudinal threads 11 and the horizontal threads 20 is at least one of the knots 21. Each of the common weaving interlacing points 31 includes at least one first thread section 22 and at least two second thread sections 23 which are separate, and the at least one first thread 22 section and the at least two second thread sections 23 are located at opposite sides of the longitudinal thread 11.

In the present embodiment, each of the longitudinal threads 11 can be a hollow thread. However, in other possible embodiments, each of the longitudinal threads can be flat or column-shaped. Besides, each of the horizontal threads 20 forms at least one the knot 21 between any two adjacent ones of the longitudinal threads 11. A distance between any two adjacent ones of the longitudinal threads is 0.5 to 5 times an external diameter of each of the longitudinal threads. A distance between any two adjacent ones of the horizontal threads is at least 0.5 to 5 times the external diameter of each of the longitudinal threads. The distance between any two adjacent ones of the horizontal threads 20 is at least triple the external diameter of each of the horizontal threads 20. The external diameter of each of the longitudinal threads 11 is at least triple the external diameter of each of the horizontal threads 20. Optionally, the longitudinal threads 11 are warp threads and each a part of a single woven thread 10. In addition, the longitudinal threads have a color different from that of the horizontal threads.

Specifically, each of the longitudinal threads 11 comprises 8 to 32 the filaments. Each of the longitudinal threads 11 is 100 to 500 denier. Each of the horizontal threads 20 is 200 to 800 denier. The external diameter of each of the longitudinal threads 11 is 0.1 to 0.2 cm. The external diameter of each of the horizontal threads 20 is 0.01 to 0.1 cm.

In other possible embodiments, a distance between at least two adjacent ones of the horizontal threads 20 is not constant so that the horizontal threads are arranged unevenly. Thus, uneven resilience and unique appearance can be provided.

Optionally, each of the hollow longitudinal threads can be inserted with a central thread 32.

In conclusion, the holes of the woven cloth make the woven cloth breathe freely, and improved resilience is also provided, specifically along the oblique direction. Besides, the density and the arrangement of the horizontal threads may provide uneven resilience for multi-purpose use. Thus, it is not necessary to take plural pieces of materials having different resilience to assemble into a single piece of cloth.

Optionally, the threads can be made of resilient material, and the horizontal threads can be woven by various filaments, such as filaments in different colors, resilience, or diameters.

What is claimed is:

1. A woven cloth, comprising:

a plurality of longitudinal threads; and a plurality of horizontal threads, each of the longitudinal threads being formed by a plurality of filaments, the longitudinal threads being spacedly arranged parallel, the horizontal threads being spacedly arranged and being woven with the longitudinal threads so that a plurality of holes being formed by the interlacing of the longitudinal threads and the horizontal threads, each of the horizontal threads surrounding and tying respective one of the longitudinal threads, each horizontal thread itself knotting to form a plurality of knots, wherein along respective one of the horizontal threads, between every two adjacent common weaving interlacing points of the longitudinal threads and the horizontal threads is at least one of the knots.

2. The woven cloth of claim 1, wherein each of the longitudinal threads is a hollow thread.

3. The woven cloth of claim 2, wherein a distance between any two adjacent ones of the longitudinal threads is 0.5 to 5 times an external diameter of each of the longitudinal threads, a distance between any two adjacent ones of the horizontal threads is at least 0.5 to 5 times the external diameter of each of the longitudinal threads.

4. The woven cloth of claim 3, wherein each of the longitudinal threads comprises 8 to 32 the filaments, each of the longitudinal threads is 100 to 500 denier, each of the horizontal threads is 200 to 800 denier.

5. The woven cloth of claim 4, wherein the longitudinal threads have a color different from that of the horizontal threads.

6. The woven cloth of claim 5, wherein the external diameter of each of the longitudinal threads is at least triple an external diameter of each of the horizontal threads.

7. The woven cloth of claim 6, wherein the longitudinal threads are warp threads.

8. The woven cloth of claim 7, wherein the external diameter of each of the longitudinal threads is 0.1 to 0.2 cm, the external diameter of each of the horizontal threads is 0.01 to 0.1 cm.

9. The woven cloth of claim 8, wherein a central thread is inserted through each of the hollow longitudinal threads.

10. The woven cloth of claim 1, wherein a distance between at least two adjacent ones of the horizontal threads is not constant.

11. The woven cloth of claim 1, wherein each of the common weaving interlacing points includes at least one first thread section and at least two second thread sections which are separate, and the at least one first thread section and the at least two second thread sections are located at opposite sides of the longitudinal thread.

* * * * *